US007632177B2

(12) United States Patent
O'Malley

(10) Patent No.: US 7,632,177 B2
(45) Date of Patent: Dec. 15, 2009

(54) COIN DISPENSER AND KIT

(76) Inventor: Thomas O'Malley, 25 Santa Barbara, Springfield, MA (US) 01104

( * ) Notice: Subject to any disclaimer, the term of this patent is extended or adjusted under 35 U.S.C. 154(b) by 149 days.

(21) Appl. No.: 10/856,506

(22) Filed: Jun. 1, 2004

(65) Prior Publication Data

US 2004/0259491 A1 Dec. 23, 2004

Related U.S. Application Data

(60) Provisional application No. 60/479,365, filed on Jun. 19, 2003.

(51) Int. Cl.
*G07D 9/06* (2006.01)

(52) U.S. Cl. ..... 453/61

(58) Field of Classification Search ..... 453/58, 453/59, 60, 61, 62; 193/DIG. 1, 25 R; 206/0.8, 206/0.83, 0.84, 445; 221/303, 304, 307, 221/312 R, 312 C, 64, 65; 232/1 D, 55, 64, 232/65, 66; 294/55; 141/108, 109; 209/418, 209/419, 702

See application file for complete search history.

(56) References Cited

U.S. PATENT DOCUMENTS 1,378,227 A * 5/1921 Greenstreet ..... 206/0.8
2,119,773 A * 6/1938 Buckner ..... 206/0.84
2,388,221 A * 10/1945 Smith et al. ..... 453/50
3,112,046 A * 11/1963 Szekely ..... 221/2
3,163,170 A * 12/1964 Gates ..... 453/61
4,091,599 A * 5/1978 Lemieux ..... 53/254
4,095,608 A * 6/1978 Holmes ..... 453/60
4,244,157 A 1/1981 Vondra et al.
4,425,927 A * 1/1984 Smith ..... 453/59
4,722,714 A 2/1988 Marbourg, Jr.
4,741,720 A 5/1988 Vargo
4,764,151 A * 8/1988 Sandhage ..... 453/59
D301,930 S 6/1989 Cantu
5,207,612 A * 5/1993 Wollaston ..... 453/61
5,271,176 A * 12/1993 Anderson et al. ..... 42/106
5,360,370 A * 11/1994 Woolrich ..... 453/59
5,830,055 A * 11/1998 Jones et al. ..... 453/41
6,151,779 A 11/2000 Brown

* cited by examiner

*Primary Examiner*—Patrick Mackey
*Assistant Examiner*—Mark Beauchaine
(74) *Attorney, Agent, or Firm*—Deborah A. Basile; Karen K. Chadwell

(57) ABSTRACT

Disclosed herein is a chute for dispensing coins comprising a lower wall having a proximal end and a distal end. The proximal end comprises a longitudinally extending bottom layer having a first terminal edge opposite to a second terminal edge. The distal end comprises a longitudinally extending bottom layer having a first tapered terminal edge opposite to a second tapered terminal edge. The first tapered terminal edge is joined to the first terminal edge, and the second tapered terminal edge is joined to the second terminal edge. The chute comprises a first side wall joined to the first terminal edge and to the first tapered terminal edge; a second side wall joined to the second terminal edge and to the second tapered terminal edge; and a back wall joined to the proximal end of the lower wall. Further disclosed herein is a kit comprising the chute.

11 Claims, 7 Drawing Sheets

COIN DISPENSER AND KIT

CROSS REFERENCE TO RELATED APPLICATIONS

This application claims the benefit of U.S. Provisional Application No. 60/479,365 filed on Jun. 19, 2003.

BACKGROUND OF THE INVENTION

Sliding coins down paper coin wrappers is a time consuming procedure requiring considerable dexterity. The paper wrappers themselves tend to collapse while holding them. This makes inserting the coins and holding them perpendicular to the paper coin wrapper quite difficult.

SUMMARY OF THE INVENTION

The above-discussed and other drawbacks and deficiencies of the prior art are overcome or alleviated by a chute for dispensing coins comprising a lower wall having a proximal end and a distal end. The proximal end comprises a longitudinally extending bottom layer having a first terminal edge opposite to a second terminal edge. The distal end comprises a longitudinally extending bottom layer having a first tapered terminal edge opposite to a second tapered terminal edge. The first tapered terminal edge is joined to the first terminal edge, and the second tapered terminal edge is joined to the second terminal edge. The chute comprises a first side wall joined to the first terminal edge and to the first tapered terminal edge; a second side wall joined to the second terminal edge and to the second tapered terminal edge; and a back wall joined to the proximal end of the lower wall. The chute can hold and dispense coins varying in diameter. Further disclosed herein is a kit comprising the chute as disclosed herein, wrappers, and containers.

DETAILED DESCRIPTION OF THE INVENTION

In general, disclosed herein is a kit used for sorting and dispensing coins. More particularly, disclosed herein is a kit comprising a plurality of wrappers, a plurality of containers, and a plurality of chutes, wherein each chute can hold coins of varying diameters, and is formed to facilitate the placement of coins into a wrapper.

The plurality of wrappers comprises wrappers designated to hold particular types of coins. For example, where the coins comprise United States ("U.S.") currency, the coins may include pennies, nickels, dimes, and quarters. The wrappers may comprise paper, plastic, and the like, and may include those wrappers currently known in the art. Although the kit may include any number of wrappers wherein the wrappers may designate any type of U.S. or international currency, in a preferred embodiment, each kit comprises a total of 80 wrappers evenly divided into 20 penny wrappers, 20 nickel wrappers, 20 dime wrappers, and 20 quarter wrappers.

Figure 1:
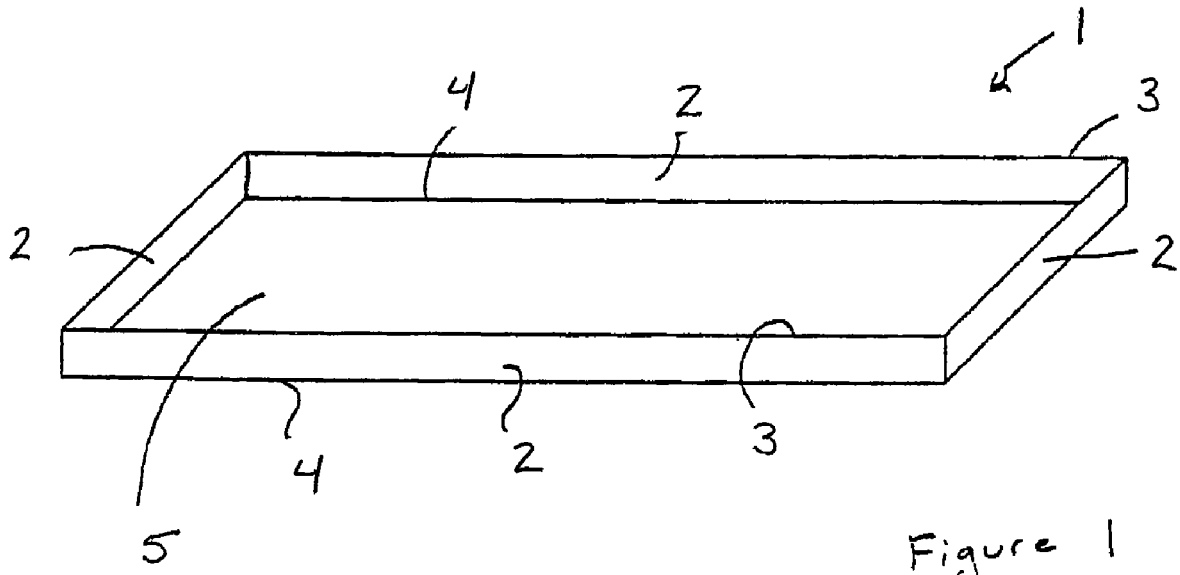
FIG. 1 is a schematic depicting an elevational view of an exemplary container.

The plurality of containers comprises individual containers, wherein the individual containers may be stacked in a vertical fashion. Although the containers may comprise any geometrical shape, including, for example, polygonal, circular, elliptical, etc., an exemplary container is depicted in FIG. 1. As shown in FIG. 1, a container 1 comprises a quadrilateral structure comprising four side walls 2 each having a top portion 3 and a bottom portion 4, and a bottom interior surface 5 connected to bottom portion 4 of side walls 2.

Figure 2:
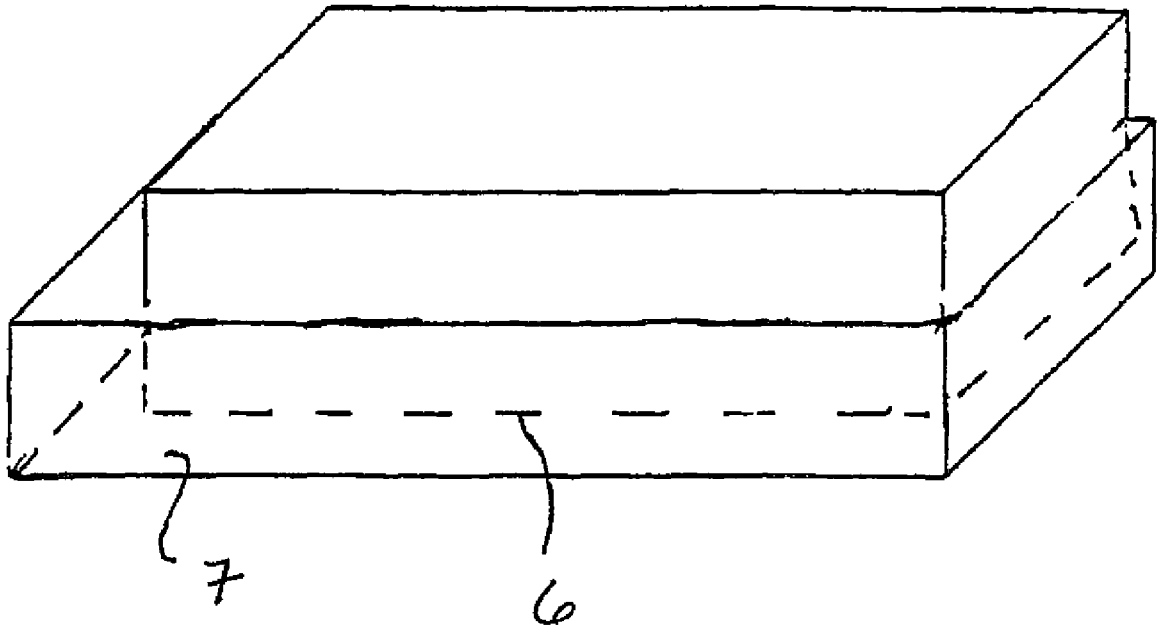
FIG. 2 is a schematic depicting an exemplary stacking arrangement of exemplary containers.

In an exemplary embodiment, the containers forming the plurality of containers are stackable. A preferred stacking arrangement is a vertical stacking arrangement in which a directly overlying container fits within a directly underlying container. FIG. 2 depicts such an exemplary stacking arrangement in which a bottom interior surface 7 of an underlying container is in contact with a bottom exterior surface 6 of a directly overlying container.

In an exemplary embodiment, the number of containers forming the plurality varies depending on the number of types of coins to be sorted. Therefore, when the kit is manufactured for sale in the U.S., the kit preferably comprises up to four containers, one for each of pennies, nickels, dimes, and quarters, e.g.

Although the exact measurements of the containers may vary widely, and are ultimately restricted based on the size restraints of the packaging of the kit, the smallest container preferably comprises a length of about 3.5 inches to about 5.5 inches, with about 4.0 inches to about 5.0 inches more preferred, and about 4.5 inches especially preferred. Furthermore, the smallest container preferably comprises a width of about 2.25 inches to about 4.25 inches, with about 2.75 inches to about 3.75 inches more preferred, and with about 3.25 inches especially preferred.

The dimensions of the other containers may be slightly adjusted based on the measurements of the smallest container such that the containers can be stacked according, for example, to the stacking arrangement depicted in FIG. 2. Preferably, each sequentially larger container is up to about 1.0 inches larger on all sides than the sequentially smaller container, wherein up to about 0.75 inches larger is more preferred, up to about 0.50 inches larger is even more preferred, and up to about 0.25 inches larger is especially preferred.

The height of each of the containers may be the same or different, wherein it is preferred that the heights be the same. The height of the containers preferably comprises up to about 3 inches, with up to about 2.5 inches more preferred.

Although the containers may be fabricated from a wide variety of materials, preferably the containers comprise plastics, wood, rubber, metals, and the like.

Additionally, the kit may comprise a plurality of lids, wherein each lid forming the plurality is formed to fit over at least a portion of the corresponding container's side walls. These lids may be used to secure the coins in the containers.

The plurality of chutes comprises individual chutes, wherein an individual chute is formed to hold coin types having varying diameters, wherein such variance may be up to about 0.2 inch, wherein up to about 0.15 inch is preferred, and up to about 0.125 inch is more preferred. The chute then of the present invention is constructed to hold a plurality of types of coins therein, and to further allow for the dispensing of the plurality of types of coins therefrom and into a wrapper. As will be discussed in further detail below with reference to the Figures, in an exemplary embodiment, the chute comprises a longitudinally extending, substantially concave shaped lower wall comprising an uppermost first terminal edge opposite to an uppermost second terminal edge, wherein each of the uppermost first and second terminal edges comprises a respective first and second longitudinally extending top edge and a respective first and second leading edge, wherein the first leading edge is coterminous with the first longitudinally extending top edge and the second leading edge is coterminous with the second longitudinally extending top edge, and further wherein each of the first and second leading edges of the lower wall extend along a straight line that is symmetrical on either side of a center line that is lateral to the chute, to a single point at a lip that forms a single radius. The chute further comprises: (1) a first longitudinally extending side wall joined to the first longitudinally extending top edge; (2) a second longitudinally extending side wall joined to the second longitudinally extending top edge; and (3) a back wall joined to the lower wall and positioned opposite to the lip. The lower wall, first side wall, second side wall, and back wall are joined to form a holding cavity. Furthermore, the lower wall, first side wall, second side wall, and back wall comprise a pliable and resilient material, whereby the holding cavity securely holds and dispenses coins varying in diameter, and wherein the lip serves as the outlet for the plurality of coins from the chute into the wrapper.

In a particularly preferred embodiment, a chute is configured to hold pennies and dimes ("PD chute"), and another chute is configured to hold nickels and quarters ("NQ chute"). Despite the specificity of PD and NQ chutes, it is to be understood that chutes for other types of coinage are contemplated herein as such chutes may require only slight modifications in size to the chutes disclosed herein, and may function by essentially the same principles. It is further noted that, as used herein, where only the term "chute" is used without the directly preceding use of the terms "PD" or "NQ", it is to be understood that the chute relates to the chute in general and, therefore, includes both the PD and NQ chutes, and further includes chutes configured to hold other types of coins, which are formed, and function, according to the teachings disclosed herein.

An exemplary chute is described generally with reference to FIGS. 3-11. Referring to these figures, a chute 10 comprises a holding cavity 12 in which a plurality of coins can be positioned and held. Holding cavity 12 is defined by side walls 14 and 16, lower wall 18, and back wall 20. Holding cavity 12 preferably comprises a volume of about 0.200 to about 0.300 cubic inches.

Figure 3:
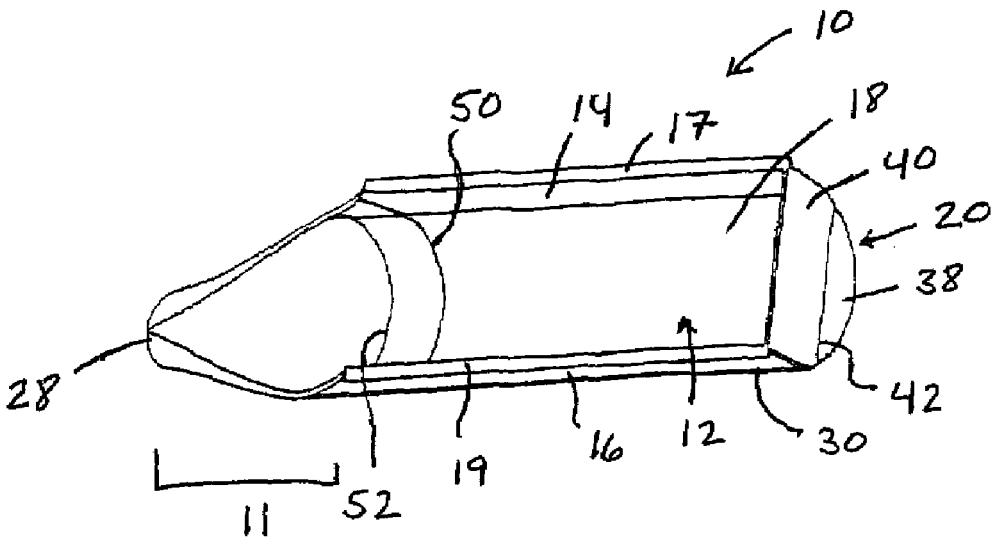
FIG. 3 is a schematic depicting an elevational top view of an exemplary chute.
Figure 5:
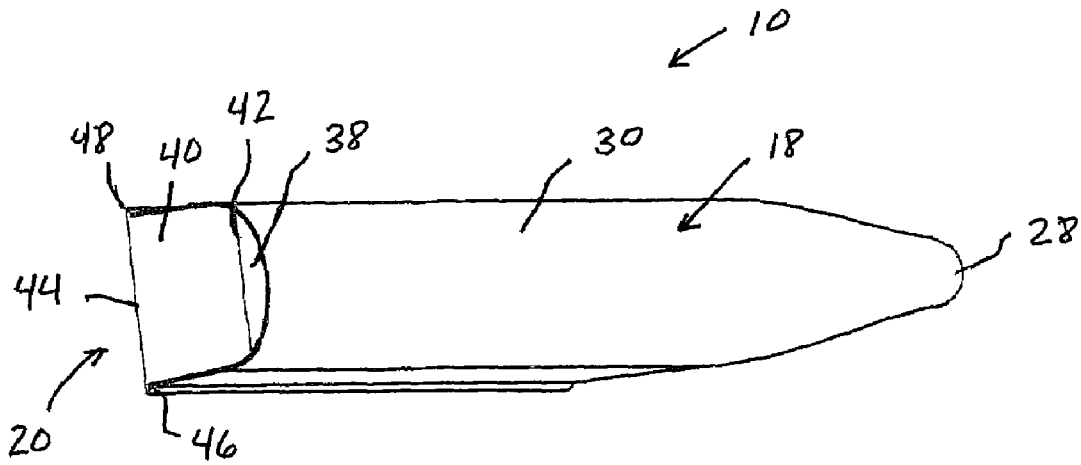
FIG. 5 is a schematic depicting an elevational view of the bottom side of the chute depicted in FIG. 3.
Figure 6:
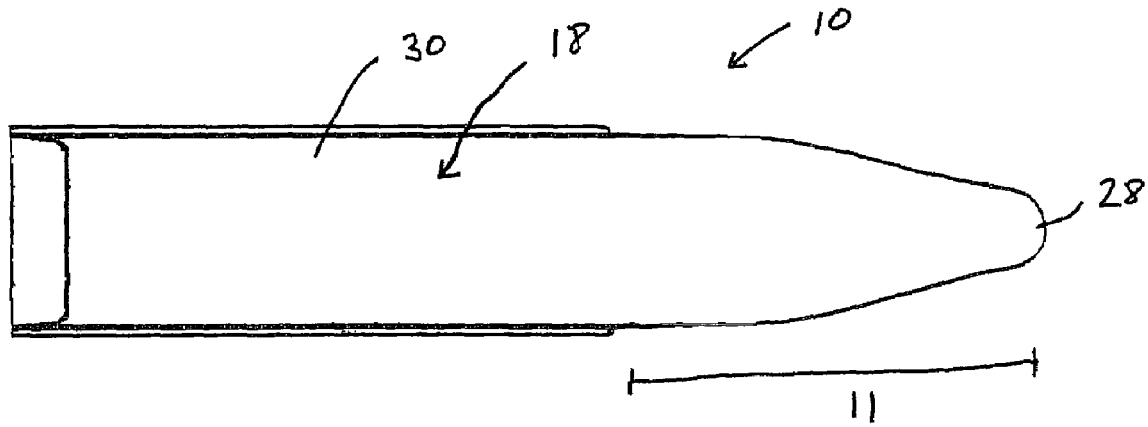
FIG. 6 is a schematic depicting a bottom side of the chute depicted in FIG. 5.

As best shown in FIGS. 3 and 5, lower wall 18 comprises a bottom layer 30 preferably having a convex curved length, wherein the curved surface complements the curve of the side of the coins. Bottom layer 31 extends to terminal edges 21 and 23, wherein terminal edge 21 connects to side wall 14 and terminal edge 23 connects to side wall 16. Additionally, lower wall 18 comprises a tapered distal end 11, wherein terminal edges 21 and 23 taper inwardly and join to form a lip 28. Lip 28 is configured in such a manner such that lip 28 can be positioned within and along an inner surface of a wrapper such that the coins can be easily dispensed from the chute into the wrapper.

Figure 7:
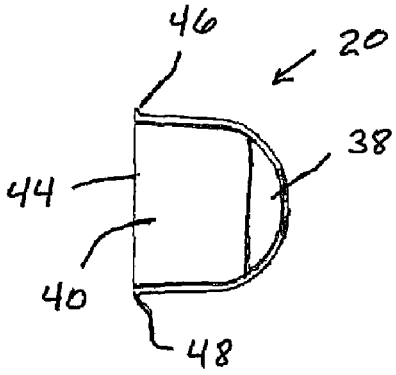
FIG. 7 is a schematic depicting a back side of the chute depicted in FIGS. 3 and 6.
Figure 8:
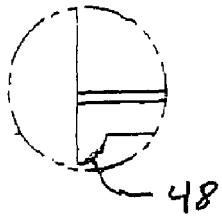
FIG. 8 is a schematic depicting a magnified portion of the back side depicted in FIG. 7.
Figure 9:
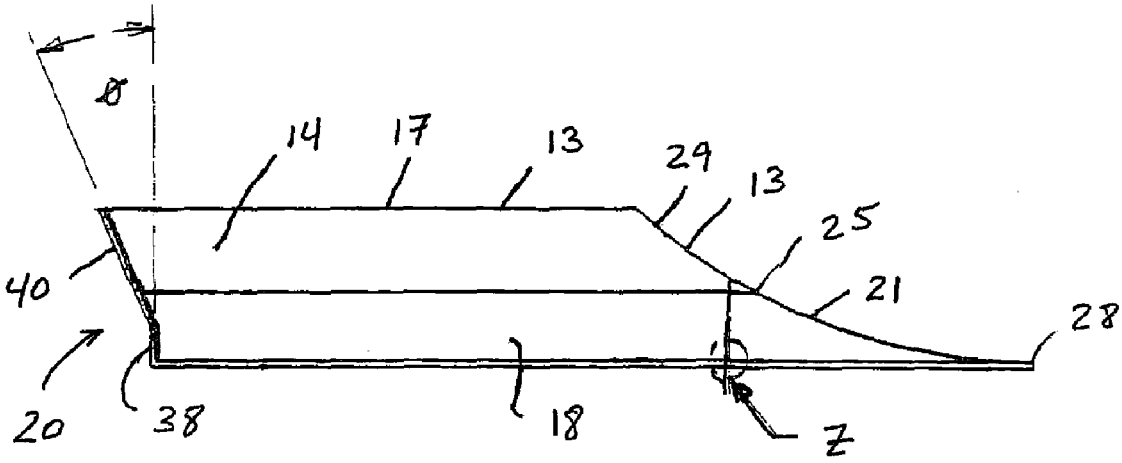
FIG. 9 is a schematic depicting a side view of an exemplary chute.
Figure 10:
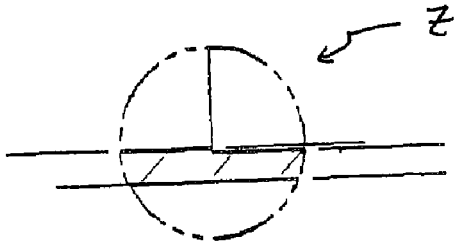
FIG. 10 is a schematic depicting a magnified portion of the chute depicted in FIG. 4.
Figure 11:
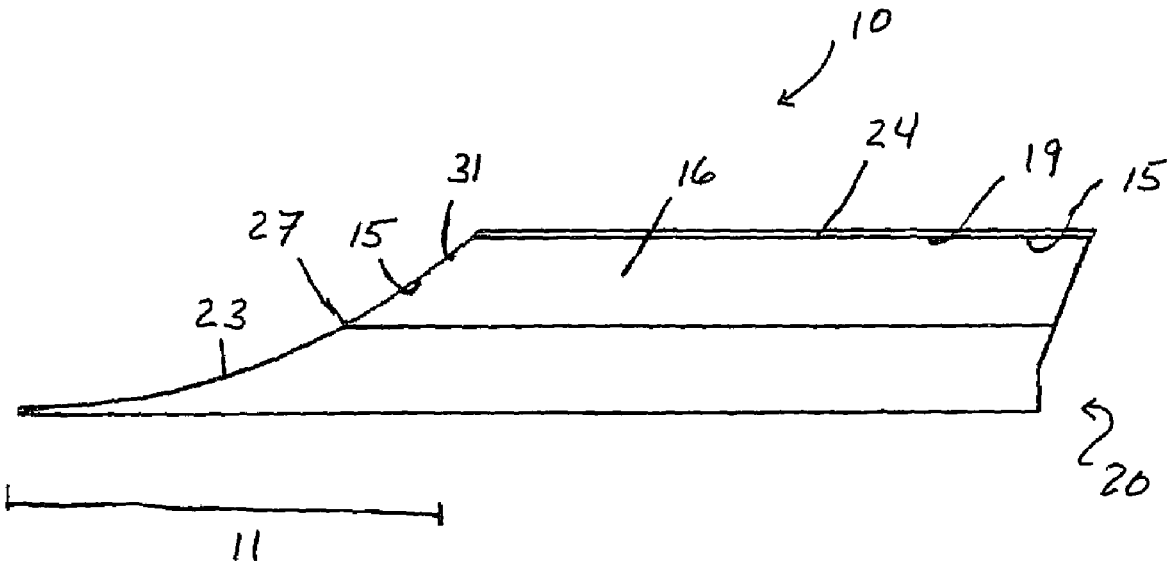
FIG. 11 is a schematic depicting a side view of the chute depicted in FIG. 3.

Referring to FIGS. 3-11, and particularly to FIGS. 9 and 11, side walls 14 and 16 each extend upwardly from terminal edges 21 and 23 respectively and terminate in horizontal top edges 13, 15 respectively, wherein a portion of top edges 13, 15 comprises a horizontal straight edged border 17, 19, and another portion of top edge 13, 15 comprises a tapered border 29, 31 that terminates at a respective point 25, 27 where tapered borders 29, 31 joins tapered terminal edges 21, 23 respectively.

Figure 4:
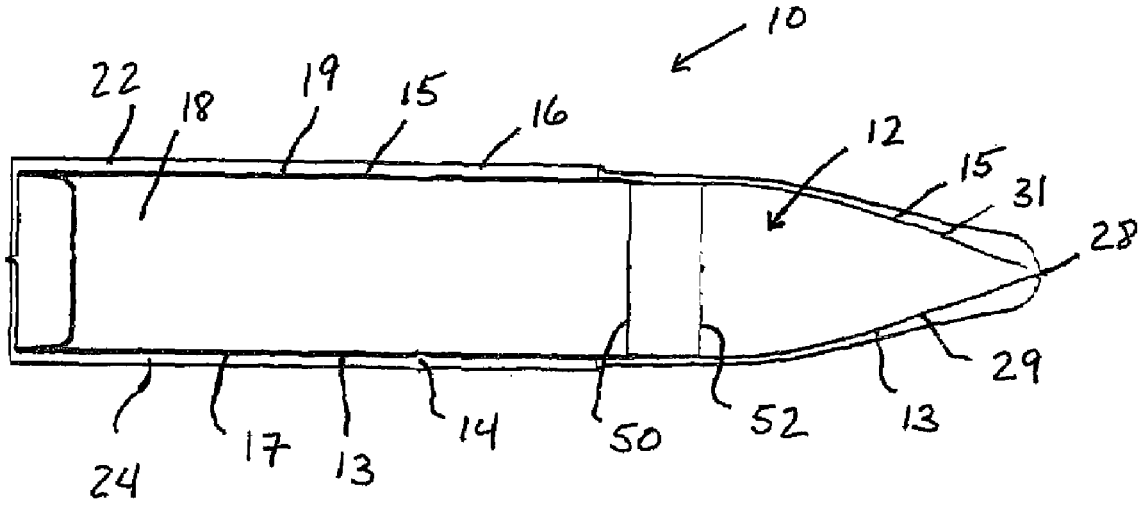
FIG. 4 is a schematic depicting an elevational view of the top side of the chute depicted in FIG. 3.

Referring to FIGS. 4 and 11, attached to and outwardly extending from horizontal straight edged borders 17, 19 may be top ridges 22 and 24 respectively. Top ridges 22 and 24 provide a means whereby a user can more easily grasp, hold onto, and press chute 10 when dispensing the coins.

Referring to FIGS. 3-11, with particular emphasis on FIGS. 4, 7, and 8, back wall 20 comprises a lower region 38 in physical communication with an upper region 40. In an exemplary embodiment, lower region 38 comprises a straight horizontal edge 42 from which upper region 40 extends to form an angle θ. Angle θ preferably comprises an angle of about 18 to about 28 degrees, with an angle of about 20 to about 25 degrees more preferred, and with an angle of about 23 degrees especially preferred. Straight horizontal edge 42 allows for the abutment of the first coin's face, e.g., the head/tail side of the coin, with back wall 20. Once all of the coins are positioned in chute 10, the coins can be repositioned from an upright position to a slightly angled position, i.e., the coins can be positioned such that the first coin lies flat with upper region 40, and the other coins can lie flat against their respective adjacent coins. This arrangement facilitates the placement of the coins into the wrapper.

Back wall 20 further comprises an edge 44 that extends along the outer periphery of back wall 20, wherein edge 44 terminates into flanges 46 and 48. Flanges 46 and 48 provide greater holding support to a user whereby flanges 46 and 48 provide a grip region such that a user is less likely to drop the chute when dispensing coins.

Chute 10 further comprises a marker 50 and a marker 52 visible on an interior surface of lower layer 18, wherein markers 50, 52 serve as indicators as to the optimal stopping point for the stacking of the coins into holding cavity 12. Marker 50 preferably serves as the indicator for the larger dimensioned coin, e.g., the quarter or the penny, and marker 52 preferably serves as the indicator for the smaller dimensioned coin, e.g., the nickel or the dime. As shown in FIGS. 3-11, both markers 50 and 52 are visible such that when the coins are stacked into position in chute 10, the coins will ideally extend into the tapered portion of chute 10. This then, allows the last coin, i.e., the coin closest to lip 28, to be in close proximity to the interior of a wrapper once lip 28 is placed along the interior side wall of the wrapper.

In an exemplary embodiment, markers 50, 52 are positioned such that the PD chute holds up to about 50 pennies or dimes, and the NQ chute holds up to about 40 nickels or quarters. The primary purpose of markers 50, 52, therefore, is to eliminate the need for a user to count the number of coins to be distributed into the wrapper so that the user does not exceed the number of coins to be positioned in the chute, thereby ensuring optimal performance.

When a user begins stacking the coins, the first coin is preferably positioned against straight horizontal edge 42 of back wall 20. The remaining coins are then sequentially placed back to back such that the bottom circular side of each coin rests on lower wall 18, and the lateral portions of the circular sides of each coin contacts side walls 14, 16 respectively. Such contact may be achieved, e.g., by hand applying a force directed against the outer sides of side walls 14, 16. The coins are sequentially stacked in such a fashion until the plurality of the larger diametered coins reaches marker 50 or until the plurality of the smaller diametered coins reaches marker 52.

The PD and NQ chutes may comprise any material sufficiently pliable and resilient such that the coins can be easily placed onto an interior surface of the chute and secured therein by side walls 14 and 16 such that the user only need exert a small amount of force by which to displace the coins from the chute. Additionally, the material is preferably sufficiently resilient such that, after use, it can return to its original shape prior to each subsequent use. Preferred materials comprise plastics, rubbers, and the like.

Additionally, the thickness of the chute, particularly the thickness of the tapering portion of the chute is preferably of sufficient size such that the tapering portion, when positioned along an interior wall of the wrapper, allows for the ready passage of the coins into the wrapper. However, the thickness must also be sufficient to allow the chute to hold the weight of the coins without breaking under normal use. Additionally, in a preferred embodiment, the thickness of the side walls is less than the thickness of the lower wall to increase the amount of flexibility of the chute while reducing the risk of breakage. In a particularly preferred embodiment, the lower wall comprises a thickness that is about 20% greater than the thickness of the side walls.

The kit disclosed herein provides elements for the efficient sorting and dispensing of coins into wrappers. That is, each type of U.S. coinage, for example, may be separated out and placed into a respective container as described herein, wherein, for example, pennies are placed into one container, nickels are placed into another container, dimes are placed into a different container, and quarters are placed into yet another container. The coins may then be positioned into the respective chute and then dispensed into a wrapper.

In the case of pennies and dimes, preferably up to about 50 of either type of coin may be placed onto the PD chute, such that the coins do not extend beyond the respective marker indicated on the PD chute. In the case of nickels and quarters, preferably up to about 40 of either type of coin may be placed onto the NQ chute, such that the coins do not extend beyond the respective marker indicated on the NQ chute. The lip of the chute, as well as an additional portion of the tapered distal end, may then be positioned within the open interior side wall of the corresponding wrapper. A slight pressure is preferably applied along the side walls and at the back wall of the chute such that the tapered portions including the lip expand to release the coins into the wrapper. Upon entry of about the first 2-5 coins, the user may prefer to shake the wrapper to ensure that the coins are properly aligned in the wrapper. As the remaining coins are deposited into the wrapper, the user may simultaneously shake the chute and wrapper to ensure that the deposited coins lie flat in the wrapper and are, therefore, properly aligned.

Figure 12:
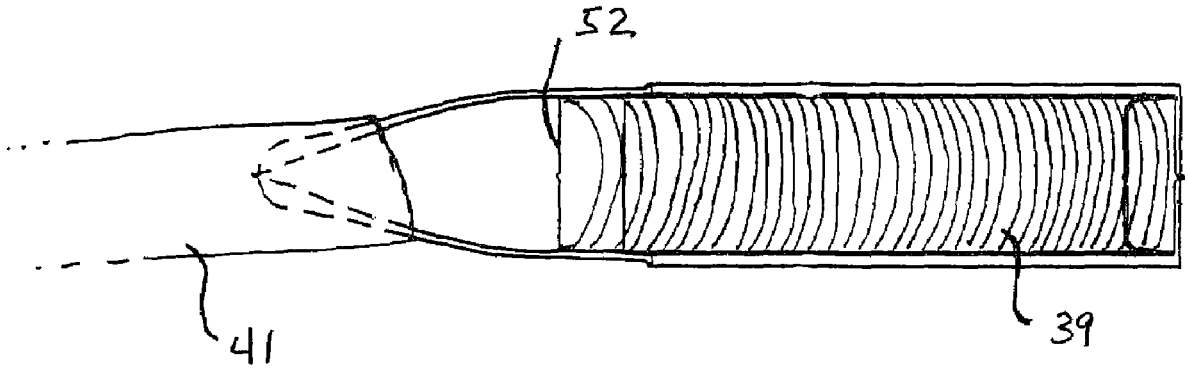
FIG. 12 is a schematic depicting an exemplary chute and wrapper.

An exemplary method for depositing coins into their respective wrappers is depicted in FIG. 12. FIG. 12 depicts coins 39 aligned with upper region 40 such that coins 39 are angled. Coins 39 are stacked to marker 52, such that the first coin abuts lower region 38. Once the coins are stacked, the coins are preferably pushed such that the first coin abuts upper region 40, thereby, angling the coins in chute 10. At least lip 28, and perhaps more of tapered distal end 11, is placed against an interior side wall of a wrapper 41. Upon such placement, the first 2-5 coins closest to marker 52 are displaced and are positioned into wrapper 41. The remaining coins may then be inserted into wrapper 41 by shaking chute 10 and/or by applying a force to back wall 20. Such movement or force causes tapered distal end 11 to distort outwardly, for example, such that the remaining coins slide through chute 10 into wrapper 41. Once all of the desired coins are fitted into wrapper 41, wrapper 41 may be closed.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A chute for placement and holding of a plurality of types of coins therein, and for dispensing the plurality of types of coins therefrom into a wrapper, wherein the chute comprises:

a longitudinally extending, substantially concave shaped lower wall comprising an uppermost first terminal edge opposite to an uppermost second terminal edge, wherein each of the uppermost first and second terminal edges comprises a respective first and second longitudinally extending top edge and a respective first and second leading edge, wherein the first leading edge is coterminous with the first longitudinally extending top edge and the second leading edge is coterminous with the second longitudinally extending top edge, and further wherein each of the first and second leading edges of the lower wall extend along a straight line that is symmetrical on either side of a center line that is lateral to the chute, to a single point at a lip that forms a single radius;

a first longitudinally extending side wall joined to the first longitudinally extending top edge;

a second longitudinally extending side wall joined to the second longitudinally extending top edge; and a back wall joined to the lower wall and positioned opposite to the lip;

wherein the lower wall, first side wall, second side wall, and back wall are joined to form a holding cavity, and further wherein the lower wall, first side wall, second side wall, and back wall comprise a pliable and resilient material, whereby the holding cavity securely holds and dispenses coins varying in diameter, and wherein the lip serves as the outlet for the plurality of coins from the chute into the wrapper.

2. The chute of claim 1, wherein the coins vary in diameter by up to about 0.2 inch.

3. The chute of claim 1, wherein the back wall comprises a lower region and an upper region, wherein the lower region is joined at an angle to the upper region.

4. The chute of claim 3, wherein the lower region comprises a curved bottom side joined to a straight edge top side, wherein the curved bottom side is coterminous with the lower wall, and wherein the straight edge top side is joined to the upper region, wherein the upper region is coterminous with the first and second longitudinally extending side walls.

5. The chute of claim 1, wherein the back wall further comprises an edge that joins the first longitudinally extending side wall to the second longitudinally extending side wall, wherein a first end of the edge terminates into a first flange that extends past the first longitudinally extending side wall, and wherein a second end of the edge terminates into a second flange that extends past the second longitudinally extending side wall.

6. The chute of claim 1, wherein the lower wall comprises a first marking and a second marking, wherein coins of a first coin type having a first diameter are stacked within the holding cavity from the back wall to the first marking, and wherein coins of a second coin type having a second diameter are stacked within the holding cavity from the back wall to the second marking, and further wherein the first diameter is greater than the second diameter.

7. The chute of claim 1, wherein the lower wall comprises a first thickness throughout the entirety of the lower wall, and wherein the first and second longitudinally extending side walls each comprise a second thickness throughout the entirety of the respective first and second longitudinally extending side walls, and further wherein the first thickness is greater than the second thickness.

8. The chute of claim 7, wherein the first thickness is about 20% greater than the thickness of the second thickness.

9. A kit for dispensing and storing a plurality of types of coins, wherein the kit comprises:

a plurality of chutes, wherein each chute comprises:

a longitudinally extending, substantially concave lower wall comprising an uppermost first terminal edge opposite to an uppermost second terminal edge, wherein each of the uppermost first and second terminal edges comprises a respective first and second longitudinally extending top edge and a respective first and second leading edge, wherein the first leading edge is coterminous with the first longitudinally extending top edge and the second leading edge is coterminous with the second longitudinally extending top edge, and further wherein each of the first and second leading edges of the lower wall extend along a straight line that is symmetrical on either side of a center line that is lateral to the chute, to a single point at a lip that forms a single radius;

a first longitudinally extending side wall joined to the first longitudinally extending top edge;

a second longitudinally extending side wall joined to the second longitudinally extending top edge; and a back wall joined to the lower wall and positioned opposite to the lip;

wherein the lower wall, first side wall, second side wall, and back wall are joined to form a holding cavity, and further wherein the lower wall, first side wall, second side wall, and back wall comprise a pliable and resilient material comprising at least one of rubber and plastic, whereby the holding cavity securely holds and dispenses coins varying in diameter, and wherein the lip serves as the outlet for the plurality of coins from the chute;

a plurality of wrappers comprising a wrapper for each type of coin; and a plurality of containers comprising a container for each type of coin.

10. The kit of claim 9, where the plurality of chutes comprises a first chute having a holding chamber capable of holding pennies and dimes, and a second chute having a holding chamber capable of holding quarters and nickels.

11. A coin dispensing system comprising:

a plurality of a first type of coin;

a plurality of a second type of coin, wherein the second type of coin comprises a diameter larger than a diameter of the first type of coin;

a holding cavity defined by a lower wall, a first side wall extending from a first uppermost terminal edge of the lower wall, a second side wall opposite to the first side wall and extending from a second uppermost terminal edge of the lower wall, and a back wall adjacent to the first and second side walls and extending from the lower wall to the terminal edges of the first and second side walls, wherein the holding cavity comprises a pliable and resilient material whereby the holding cavity securely holds and dispenses the plurality of the first type of coin and the plurality of the second type of coin, and further wherein each of the first uppermost terminal edge and the second uppermost terminal edge of the lower wall extends along a straight line that is symmetrical on either side of a center line that is lateral to the chute, to a single point at a lip that forms a single radius, wherein the lip provides an outlet for the coins from the chute;

wherein a bottom circular side of each coin rests on the lower wall, and a first lateral portion of each coin contacts the first side wall, and a second lateral portion of each coin contacts the second side wall.

* * * * *